US009033411B2

(12) United States Patent
Mezzera

(10) Patent No.: US 9,033,411 B2
(45) Date of Patent: May 19, 2015

(54) CHAIR HAVING A DYNAMICALLY-FLEXIBLE BACK AND SEAT

(71) Applicant: Marcelo Mezzera, Rancho Santa Margarita, CA (US)

(72) Inventor: Marcelo Mezzera, Rancho Santa Margarita, CA (US)

( * ) Notice: Subject to any disclaimer, the term of this patent is extended or adjusted under 35 U.S.C. 154(b) by 0 days.

(21) Appl. No.: 13/624,114

(22) Filed: Sep. 21, 2012

(65) Prior Publication Data

US 2014/0084653 A1 Mar. 27, 2014

(51) Int. Cl.

| | |
|---|---|
| ***A47C 7/38*** | (2006.01) |
| ***A47C 7/46*** | (2006.01) |
| ***A47C 7/44*** | (2006.01) |

(52) U.S. Cl.

CPC ... *A47C 7/38* (2013.01); *A47C 7/46* (2013.01); *A47C 7/44* (2013.01)

(58) Field of Classification Search

CPC ..... B60N 2/66; B60N 2/62; A47C 7/38
USPC ..... 297/123, 463.2, 452.3, 452.31, 452.32, 297/452.33, 452.36, 230.1, 230.11, 230.13, 297/230.14, 112, 411.44, 391, 216.12, 297/284.4, 284.11, 452.48, 452.58, 452.61, 297/4, 52.6, 452.62

See application file for complete search history.

(56) References Cited

U.S. PATENT DOCUMENTS

| | | | | |
|---|---|---|---|---|
| 2,843,195 | A * | 7/1958 | Barvaeus | 297/284.4 |
| 3,193,328 | A * | 7/1965 | Baermann | 297/452.21 |
| 3,635,524 | A * | 1/1972 | Faust | 297/284.11 |
| 4,178,038 | A * | 12/1979 | Yada et al. | 297/391 |
| 6,334,650 | B1 * | 1/2002 | Chien-Chuan | 297/284.1 |
| 7,963,609 | B2 * | 6/2011 | Jinkun | 297/411.32 |

* cited by examiner

*Primary Examiner* — Syed A Islam

(74) *Attorney, Agent, or Firm* — Morland C. Fischer

(57) ABSTRACT

A chair including a dynamically-flexible back and seat having a shape that adjusts to the movements of a user seated in the chair to enhance user comfort. Each of the back and seat has an air gap formed therewithin and a resilient frame or liner with a spring memory. The resilient liner is adapted to flex in response to compressive forces that are generated as the user slides his body back or from side-to-side in the chair. Accordingly, some of the chair back and some of the chair seat move into respective air gaps so that the shapes of the back and seat change to conform to the movements of the user. The air gaps also establish air flow ventilation channels which run laterally through the back and seat of the chair.

10 Claims, 3 Drawing Sheets

CHAIR HAVING A DYNAMICALLY-FLEXIBLE BACK AND SEAT

BACKGROUND OF THE INVENTION

1. Field of the Invention

This invention relates to a home or office chair including a dynamically-flexible back and seat having a shape that adjusts to the movements of a user seated in the chair. The back and seat of the chair carry a resilient frame or liner that is adapted to flex in response to compressive forces generated as the user slides his body from side-to-side in the chair.

2. Background Art

Chairs of the kind commonly found in an office or at home have a back and seat to support the body of a user. To enhance the comfort of the user, the back and seat of the chair are often padded or provided with a cushion material. Despite this comfort feature, the back and seat of the usual home or office chair have a relatively inflexible contour which is unable to change to conform to the shape of the user's body should he turn or move from side-to-side in the chair. That is to say, the user is likely to encounter a generally stiff chair back and seat when his initial at-rest centered position changes. This disadvantage can lead to user discomfort if the user slides along the chair.

Accordingly, what is desirable is an improved chair having a dynamically-flexible back and seat to overcome the aforementioned disadvantage, such that the shape of back and seat changes in response to compressive forces generated as the user slides his body back or from side-to-side in the chair.

SUMMARY OF THE INVENTION

Briefly, and in general terms, a home or office chair is disclosed having a dynamically-flexible back and seat to enhance the comfort of one seated in the chair as his position in the chair changes. The chair back includes an upstanding, generally vertical back support. A head rest portion to support a user's head and a lumbar portion to support the user's lower back are disposed one above the other and attached to the back support of the chair back. The head rest and lumbar portions have an arcuate (i.e., arched) configuration, such that an air gap is established between each of the head rest and lumbar portions and the opposing back support. The seat of the chair includes a generally horizontal seat support that extends outwardly from the chair back. An arcuate (i.e., arched) seat cushion to support the user's thighs and torso is spaced above and attached to the seat support, such an air gap is established between the seat cushion and the opposing seat support.

In accordance with a preferred embodiment, each of the head rest and lumbar portions of the chair back and the seat cushion of the chair seat carries a flexible frame or liner which is manufactured from a resilient material having a spring memory. The head rest and lumbar portions are tied to the back support, such that the flexible liners lie in opposite facing alignment with the back support. The seat cushion is tied to the seat support, such that the flexible liner thereof lies in opposite facing alignment with the seat support.

Each of the flexible liners carried by the head rest portion and the lumbar portion of the chair back and by the seat cushion of the chair seat is adapted to bend in response to compressive forces generated by the user shifting his body back or from side-to-side. By virtue of the foregoing, the head rest portion, lumbar portion and seat cushion move towards the back support and the seat support and into respective air gaps such that the shapes adjust to conform to the shape of the user's body and thereby maximize user comfort. Because of the spring characteristic thereof, the flexible liners will expand, and the head rest portion, lumbar portion and seat cushion of the chair will automatically return to their initial centered position and arcuate shape when the user is at rest or no longer seated in the chair.

DESCRIPTION OF THE PREFERRED EMBODIMENT

Details for a chair 1 having a dynamically-flexible back and seat are disclosed while referring concurrently to FIGS. 1-6 of the drawings. The chair 1 is of the type that would be commonly found in a home or office. However, the dynamically-flexible back and seat of this invention may also be used with a variety of different chairs. As will be described in greater detail hereinafter, the chair 1 provides improved user comfort by means of having a shape which is adjustable in response to the movements of a seated individual. At the same time, the chair 1 is constructed to promote air flow, heat dissipation and cooling to further enhance the comfort of the user.

Figure 1:
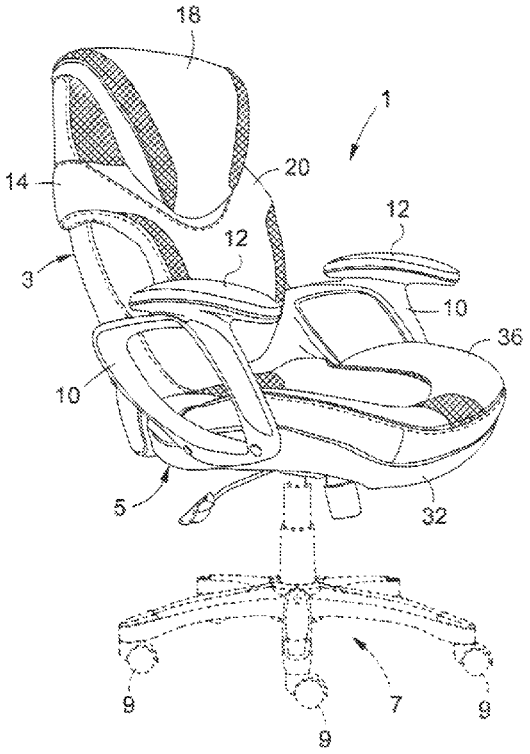
FIG. 1 is a perspective view of a chair having a dynamically-flexible back and seat according to a preferred embodiment of this invention.
Figure 2:
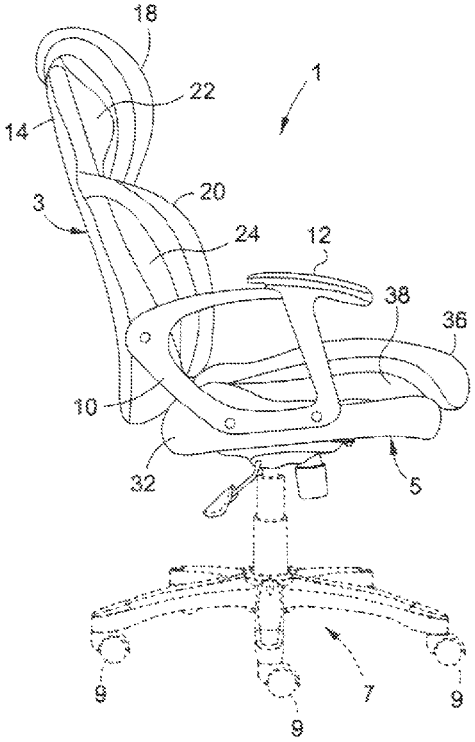
FIG. 2 is a side view of the chair of FIG. 1.
Figure 3:
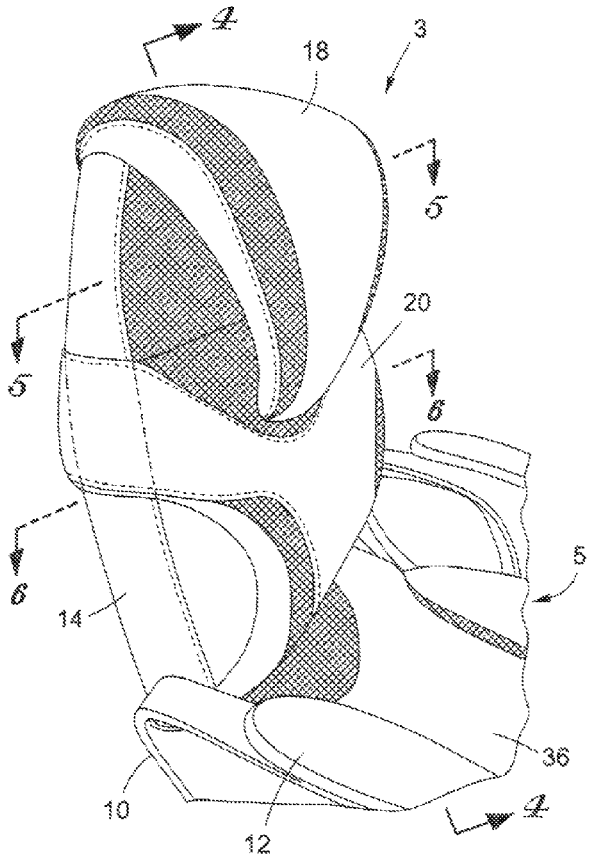
FIG. 3 is a partial perspective view showing details of the back and seat of the chair of FIG. 1.
Figure 4:
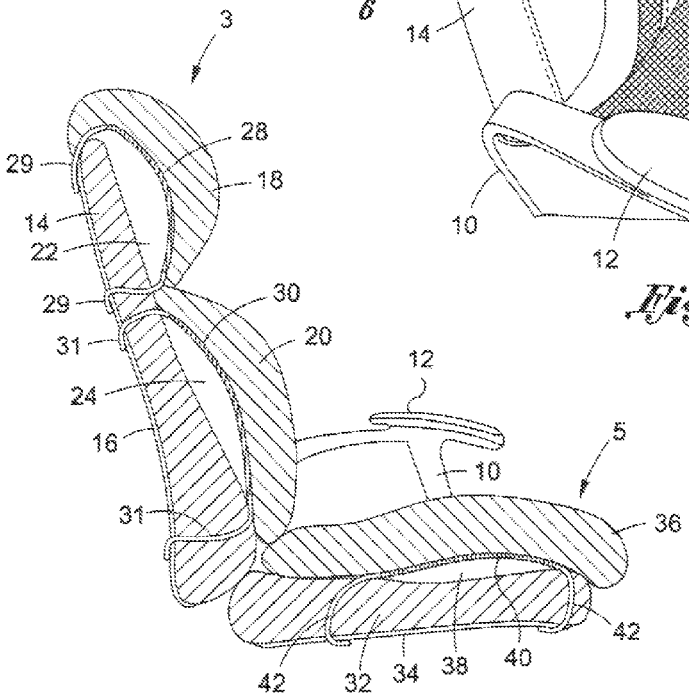
FIG. 4 is a cross-section taken along lines 4-4 of FIG. 3.

As is best shown in FIGS. 1 and 2, the chair 1 includes a back 3 against which the user's back is rested, a seat 5 to support the weight of the user, and an adjustable base 7 to hold the back 3 and seat 5 off the ground. The base 7 (shown in broken lines) includes a set of rollers 9 to enable the chair 1 to be moved from place-to-place. However, the advantages of this invention are applicable to chairs with a base other than that shown in FIGS. 1 and 2, including chairs with legs or with no base at all. Thus, the base 7 of the chair 1 shown in FIGS. 1 and 2 is not to be regarded as a limitation of this invention.

A pair of arms 10 are located at opposite sides of the chair 1. Each arm 10 is connected between the back 3 and the seat 5 of chair 1. A cushion arm rest 12 is mounted atop each of the arms 10 to receive and support the arms of the user. Like the base 7, the particular arms of the chair 1 and the manner in which the arms are connected to the chair 1 should not be regarded as a limitation of this invention.

Referring to FIGS. 3-6 of the drawings, details are now provided of the back 3 and seat 5 of the chair 1 and the improved comfort features which are characteristic thereof. The back 3 includes a back support 14 which stands upwardly and generally vertically from the seat 5. The back support 14 is typically manufactured from a firm material that is affixed (e.g., adhesively bonded) to a relatively rigid backing 16 manufactured from plywood or the like.

Figure 5:
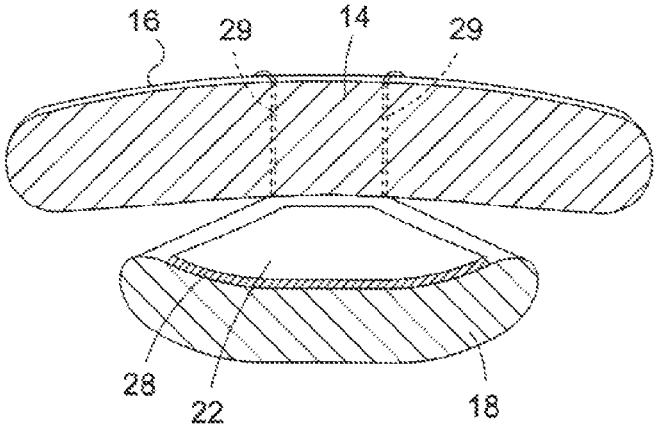
FIG. 5 is a cross-section taken along lines 5-5 of FIG. 3.
Figure 6:
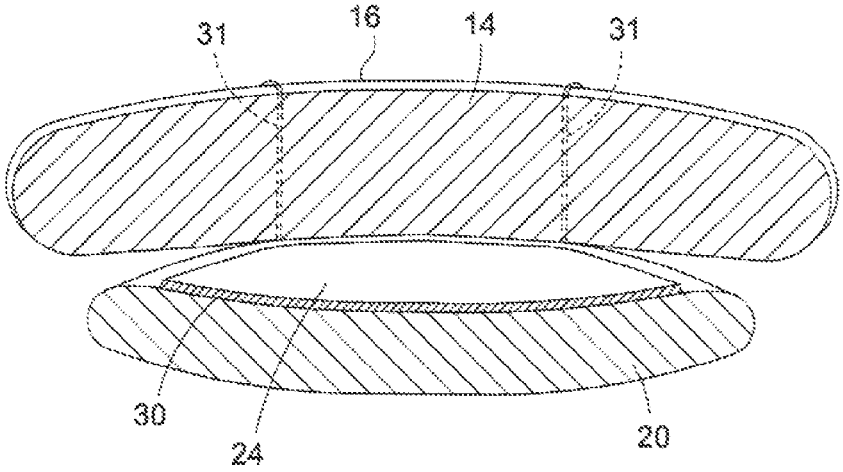
FIG. 6 is a cross-section taken along lines 6-6 of FIG. 3.

The back 3 of the chair 1 also includes a head rest portion 18 to receive the user's head thereagainst and a lumbar portion 20 against which the user's lower back is positioned. Each of the head rest and lumbar portions 18 and 20 is preferably manufactured from a comfortable cushion (e.g., foam) material. The head rest and lumbar portions 18 and 20 are positioned one above the other and attached to the back support 14 of the back 3 of the chair 1. That is, and as is best shown in FIG. 5, the head rest portion 18 is held against the back support 14 by means of (e.g., plastic) ties 29 which extend from the head rest portion 18, through the back support 14, to the backing 16 of the back support 14. As is best shown in FIG. 6, the lumbar portion 20 is held against the back support 14 by means of similar ties 31 which extend from the lumbar portion 20, through the back support 14, to the backing 16 of the back support 14.

The head rest and lumbar portions 18 and 20 have a generally arcuate or similar arched shape such that a first air gap 22 is created between the head rest portion 18 and the opposing back support 14, and a second air gap 24 is created between the lumbar portion 20 and the opposing back support 14.

As an important feature of the present invention, the back 3 of the chair 1 is adapted to change its original, at-rest shape in response to the movements of the user. To this end, a first flexible frame or liner 28 is carried by (e.g., glued to) the head rest portion 18 so as to lie in opposite facing alignment with the back support 14. As is also shown in FIGS. 5 and 6, the first air gap 22 is located between the back support 14 and the flexible liner 28 carried by the head rest portion 18. A second flexible frame or liner 30 is carried by (e.g., glued to) the lumbar portion 20 so as to also lie in opposite facing alignment with the back support 14. Thus, the second air gap 24 is located between the back support 14 and the flexible liner 30 carried by the lumbar portion 20. By way of example only, the first and second flexible liners 28 and 30 of the head rest and lumbar portions 18 and 20 of the back 3 of chair 1 are ideally manufactured from a resilient mesh or metal wire which has a characteristic spring memory. It may be appreciated that the first and second flexible liners 28 and 30 are held in front of the back support 14 so as to receive and be responsive to compressive forces applied to the head rest and lumbar portions 18 and 20 as the user changes the position of his back against the back 3 of the chair 1.

The seat 5 of the chair includes a seat support 32 which extends outwardly and generally horizontally from the upstanding seat 3. The seat support 32 is typically manufactured from a firm material that is affixed to a relatively rigid backing 34. The seat 5 also includes a seat cushion 36 that lays over top and is securely tied the seat support 32 to receive the user's thighs and torso thereagainst. The seat cushion 36 is preferably manufactured from a comfortable cushion material. The seat cushion 36 has a generally arcuate or similar arched shape such that a third air gap 38 is created between the seat support 32 and the opposing seat cushion 36.

As another important feature of this invention, the seat 5 of the chair 1 is adapted to change its original, at-rest shape in response to the movements of the user. More particularly, a third flexible frame or liner 40 is carried by (e.g., glued to) the seat cushion 36 so as to lie in opposite facing alignment with the seat support 32. Thus, the third air gap 38 is located between the seat support 32 and the seat cushion 36. The third flexible liner 40 of the seat cushion 36 is ideally manufactured from a resilient mesh or metal wire which has a characteristic spring memory. It may be appreciated that the third flexible liner 40 is held above the seat support 32 so as to receive and be responsive to compressive forces applied to the seat cushion 36 as the user shifts his weight along the seat 5 of the chair 1.

By virtue of the resilient nature of the first, second and third flexible liners 28, 30 and 40, the original, at-rest arcuate shapes of one or more of the head rest portion 18, the lumbar portion 20, and the seat cushion 36 of the back and seat 3 and 5 can change to provide the user with enhanced comfort and support as he shifts his body and his weight within the chair 1. More particularly, the flexible liners 28, 30 and 40 will be stressed and bend in response to compressive forces that are generated when the user presses his body against or slides from side-to-side over the head rest portion 18 and the lumbar portion 20 of the chair back 3 and the seat cushion 36 of the chair seat 5. Rather than providing a firm resistance to the user's movements as in the case of a conventional chair, the flexible liners 28, 30 and 40 enable the head rest portion 18, lumbar portion 20 and seat cushion 36 to be compliant and thereby change their shape depending upon the position of user's body and how much force is exerted on the back and seat 3 and 5 of the chair 1.

In particular, the flexible liners 28 and 30 are adapted to flex and store energy, such that the head rest portion 18 and the lumbar portion 20 of the chair back 3 will correspondingly move towards the opposing back support 14 and into the air gaps 22 and 24. Hence, the size of the air gaps 22 and 24 is reduced to absorb the force generated by the user's body. At the same time, the flexible liner 40 is adapted to flex and store energy, such that the seat cushion 36 will correspondingly move towards the opposing seat support 32 and into the air gap 38, whereby the size of the air gap 38 is also reduced. Because of the resilient nature and spring-like memory of the flexible liners 28, 30 and 40, the liners will release their stored energy and expand to their initial pre-stressed condition whenever the user exits the chair 1. In this same regard, the head rest portion 18, lumbar portion 20 and seat cushion 36 of the chair back and seat 3 and 5 will automatically move out of the respective air gaps 22, 24 and 38 and return to their original at-rest centered position and arcuate shape.

The air gaps 22, 24 and 38 provide the chair 1 with the additional advantage of air flow paths which extend laterally through the chair back and seat 3 and 5. The air flow paths facilitate the dissipation of heat and promote cooling to make the chair more comfortable for the user.

The invention claimed is:

1. A chair comprising a back and a seat, said back including a firm back support, an opposing flexible back rest spaced from said firm back support such that a first air space is created therebetween, first resilient means comprising a flexible liner carried by said flexible back rest in opposite facing alignment with said firm back support and having a top, a bottom and a spring memory, a first pair of ties being spaced from one another and extending from the top of said flexible liner through said firm back support for attaching said top to said firm back support, and a second pair of ties being spaced from one another and extending from the bottom of said flexible liner through said firm back support for attaching said bottom to said firm back support, said flexible liner bending between said first and second pairs of ties and moving with said flexible back rest towards said firm back support and into said first air space to cause the shape of said chair back to change in response to compressive forces generated by a user's movements in the chair pushing back and sliding side-to-side against the flexible back rest, and said flexible liner expanding between said first and second pairs of ties and moving with said flexible back rest out of said first air space and away from said firm back support after the compressive forces generated by the user's movements are terminated, whereby the chair back returns to its original shape prior to said first resilient means bending.

2. The chair recited in claim 1, wherein the flexible back rest of the back of the chair and the flexible liner carried by said back rest have an arcuate shape prior to the user moving in the chair and said flexible liner bending in response thereto.

3. The chair recited in claim 1, wherein the chair back also includes a head rest portion to receive the user's head thereagainst, said head rest portion being spaced from said back support by a second air space, and second resilient means carried by said head rest portion and having a spring memory, said second resilient means moving with said head rest portion towards said back support and into said second air space to cause said second resilient means to bend and the shape of said chair back to further change in response to compressive forces generated by a user's movements in the chair against the head rest portion, and said second resilient means expanding and moving with said head rest portion out of said second air space and away from said back support after the compressive forces generated by the user's movements are terminated, whereby the chair back returns to its original shape prior to said second resilient means bending.

4. The chair recited in claim 3, wherein the second resilient means carried by said head rest portion is a flexible liner that lies against said head rest portion in opposite facing alignment with said back support.

5. The chair recited in claim 3, wherein the chair seat includes third resilient means having a spring memory, the third resilient means of said chair seat bending in response to the compressive forces generated by the user's movements in the chair against the seat, whereby the shape of said chair seat also changes when said third resilient means bends.

6. The chair recited in claim 5, wherein the seat of said chair has a third air space formed therein, at least some of said seat moving into said third air space to cause the shape of said seat to change when the third resilient means of said chair seat bends in response to the compressive forces generated by the user's movements in the chair against the seat.

7. The chair recited in claim 6, wherein the seat of said chair has a seat support and an opposing seat cushion spaced from said seat support such that said third air space is located therebetween, said seat cushion carrying said third resilient means and moving with said third resilient means towards said seat support and into said third air space to cause the shape of said chair seat to change when the third resilient means carried by said seat cushion bends in response to the compressive forces generated by the user's movements in the chair against the seat cushion.

8. The chair recited in claim 7, wherein each of the seat cushion of the seat of the chair and said third resilient means carried by seat cushion has an arcuate shape prior to the user moving in the chair and the third resilient means carried by said seat cushion bending in response thereto.

9. The chair recited in claim 7, wherein the third resilient means carried by the seat cushion is a flexible liner that lies against said seat cushion in opposite facing alignment with said seat support.

10. The chair recited in claim 7, wherein the third resilient means carried by the seat cushion of said chair seat is a flexible liner that runs along said seat cushion, said flexible liner expanding and thereby causing the seat cushion of said chair seat to correspondingly move away from the seat support of said chair seat and out of the third air space between said seat support and said seat cushion after the compressive forces generated by the user's movements are terminated so that said chair seat returns to its original shape prior to said flexible liner bending.

* * * * *